US010319281B2

(12) United States Patent
Bergquist

(10) Patent No.: US 10,319,281 B2
(45) Date of Patent: Jun. 11, 2019

(54) METHOD, APPARATUS AND/OR COMPUTER PROGRAM FOR CONTROLLING LIGHT OUTPUT OF A DISPLAY

(71) Applicant: Nokia Technologies Oy, Espoo (FI)

(72) Inventor: Johan Bergquist, Tokyo (JP)

(73) Assignee: Nokia Technologies Oy, Espoo (FI)

( * ) Notice: Subject to any disclaimer, the term of this patent is extended or adjusted under 35 U.S.C. 154(b) by 27 days.

(21) Appl. No.: 15/123,467

(22) PCT Filed: Feb. 19, 2015

(86) PCT No.: PCT/FI2015/050099
§ 371 (c)(1),
(2) Date: Sep. 2, 2016

(87) PCT Pub. No.: WO2015/132458
PCT Pub. Date: Sep. 11, 2015

(65) Prior Publication Data
US 2017/0092187 A1 Mar. 30, 2017

(30) Foreign Application Priority Data
Mar. 4, 2014 (GB) ..... 1403749.3

(51) Int. Cl.
*G09G 3/20* (2006.01)

(52) U.S. Cl.
CPC ..... *G09G 3/2092* (2013.01); *G09G 3/20* (2013.01); *G09G 2300/0456* (2013.01); *G09G 2310/0237* (2013.01); *G09G 2320/0247* (2013.01); *G09G 2320/0285* (2013.01); *G09G 2320/0606* (2013.01); *G09G 2320/0626* (2013.01); *G09G 2320/0666* (2013.01); *G09G 2320/0673* (2013.01); *G09G 2340/0435* (2013.01); *G09G 2360/141* (2013.01); *G09G 2360/144* (2013.01); *G09G 2360/145* (2013.01)

(58) Field of Classification Search
CPC ..... G09G 3/34–3/3426; G09G 2360/14–2360/141; G09G 2360/144–2360/145; G09G 2310/0237
USPC ..... 345/102, 207
See application file for complete search history.

(56) References Cited

U.S. PATENT DOCUMENTS

| | | | | |
|---|---|---|---|---|
| 2002/0044116 | A1* | 4/2002 | Tagawa | G09G 3/3406 345/87 |
| 2007/0279369 | A1 | 12/2007 | Yao et al. | 345/102 |
| 2008/0248837 | A1 | 10/2008 | Kunkel | 455/566 |
| 2010/0301755 | A1 | 12/2010 | Pance et al. | 315/149 |
| 2011/0050147 | A1 | 3/2011 | Come et al. | 318/632 |
| 2014/0132158 | A1* | 5/2014 | Land | G09G 3/20 315/152 |
| 2015/0116195 | A1 | 4/2015 | Yokonuma | |

* cited by examiner

*Primary Examiner* — Michael Pervan
(74) *Attorney, Agent, or Firm* — Harrington & Smith

(57) ABSTRACT

A method including causing synchronization of a local time frame and refresh of a display; processing an output from a light sensor from a first time, in the local time frame, for a controlled first duration to control light output of the display at a second time, in the local time frame and after the first time, for a second duration.

20 Claims, 3 Drawing Sheets

METHOD, APPARATUS AND/OR COMPUTER PROGRAM FOR CONTROLLING LIGHT OUTPUT OF A DISPLAY

TECHNOLOGICAL FIELD

Embodiments of the present invention relate to a method, an apparatus and/or a computer program for controlling light output from a display.

BACKGROUND

Ambient light has an effect on how an image displayed in a display device appears to a user. As the ambient light changes, the appearance of the image changes. For example, the contrast and/or colour saturation may be affected by ambient light.

In some situations ambient light can change very rapidly, for example, when entering into bright sunshine.

Existing methodologies for adapting the output of a display device in response to changing ambient lighting conditions have a number of drawbacks. It would therefore be desirable to provide a different method for controlling light output of a display.

BRIEF SUMMARY

According to various, but not necessarily all, embodiments of the invention there is provided a method comprising: causing synchronisation of a local time frame and refresh of a display; processing an output from a light sensor from a first time, in the local time frame, for a controlled first duration to control light output of the display at a second time, in the local time frame and after the first time, for a second duration.

According to various, but not necessarily all, embodiments of the invention there is provided a method comprising: switching a light source for a display off during a first duration of a display period; measuring ambient light during each first duration of a display period; switching the light source for the display on during a second duration of a display period with an adjusted light output, dependent on the measurement of ambient light made in the first duration of the display period.

According to various, but not necessarily all, embodiments of the invention there is provided an apparatus comprising: an ambient light sensor configured to sense ambient light; a light source configured to emit light; and optics shared by the light sensor and the light source, wherein the optics is configured to provide equivalent light paths, in opposite directions, for ambient light sensed at the light sensor and for emitted light emitted from the light source According to various, but not necessarily all, embodiments of the invention there is provided examples as claimed in the appended claims.

BRIEF DESCRIPTION

For a better understanding of various examples that are useful for understanding the brief description, reference will now be made by way of example only to the accompanying drawings in which.

Figure 6:
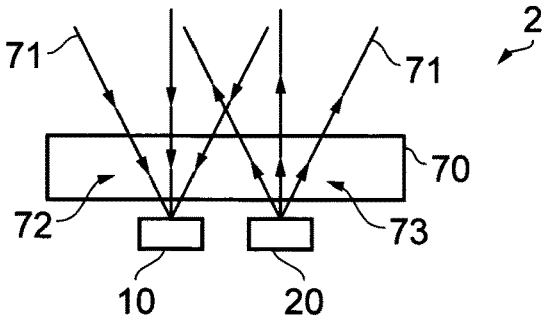
Figure 7A:
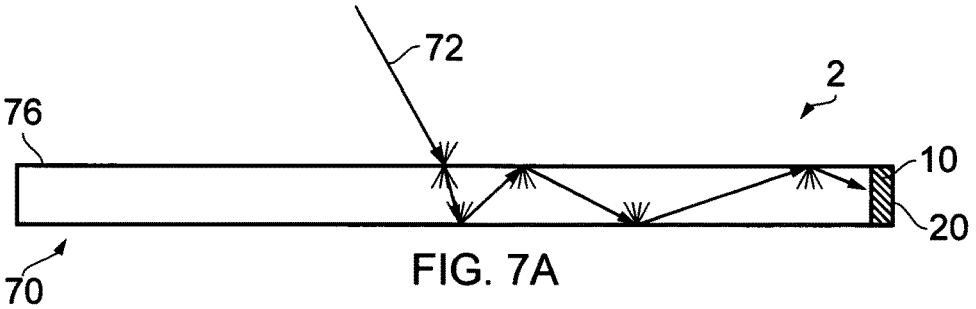
Figure 7B:
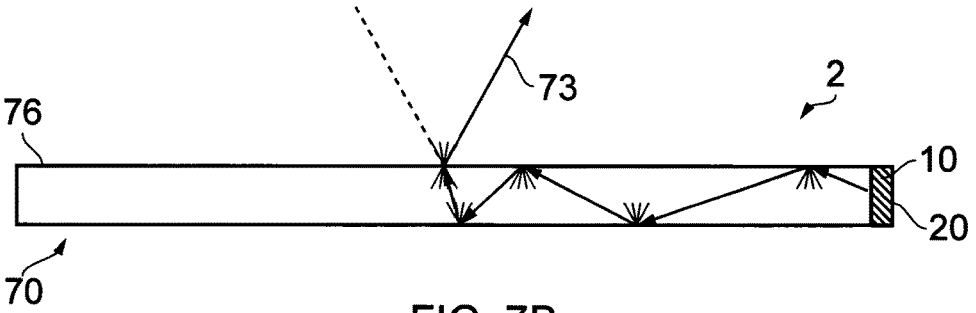
Figure 8A:
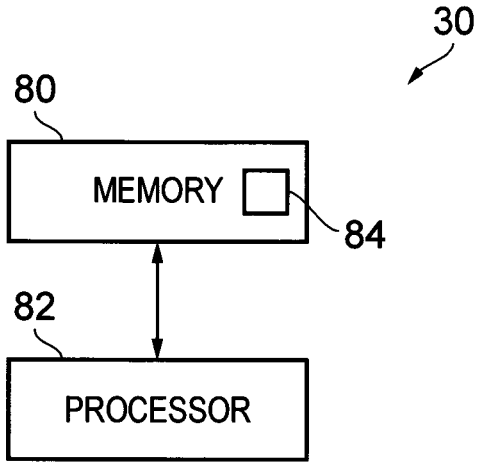

FIG. 6 schematically illustrates an apparatus configured such that an angular/spatial distribution of sensed ambient light is the same as an angular distribution of the emitted light;

FIG. 7A illustrates an example light ray for sensed ambient light;

FIG. 7B illustrates an example light ray for emitted light;

FIG. 8A illustrates an example of a controller; and

Figure 8B:
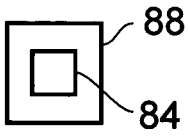

FIG. 8B illustrates an example of a record carrier for a computer program.

DETAILED DESCRIPTION

The inventor has developed various innovative approaches to improving control of light output from a display in response to sensed light.

For example, by synchronizing light sensing and display output to a common time frame, it is possible to provide a fast response to changing ambient lighting conditions that avoids flicker in the display.

For example, it is possible to provide for more accurate response to ambient lighting conditions by arranging for the use of equivalent light paths, in opposite directions, for sensing ambient light and for outputting light. In this way, provided that the optical stack response is symmetrical with respect to the display stack normal, the field of view (FoV) of the light source and of the light sensor are the same. This means that the angular/spatial distribution of sensed ambient light is the same as the angular/spatial distribution of emitted light. Also the spectral modulation of sensed ambient light may be same as a spectral modulation of light emitted. In this way, if the output of the light source is matched to the sensed light, then the output of the display is accurately matched to the ambient lighting conditions both with respect to luminance and colour temperature.

In some, but not necessarily all, examples the light sensor may be directly connected to circuitry that controls the light output. This reduces latencies and provides for faster operation.

Figure 1:
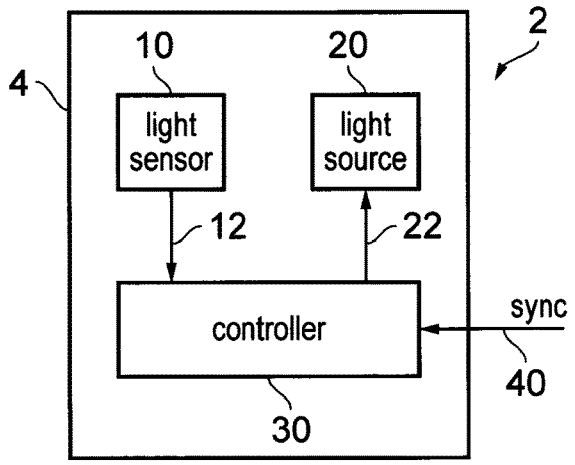
FIG. 1 illustrates an example of an apparatus comprising a light sensor, a controller and a light source.

FIG. 1 illustrates and example of an apparatus 2 comprising a light sensor 10, a controller 30 and a light source 20.

The light sensor 10 is directly connected to the controller 30. An output 12 from the light sensor 10 is therefore received by the controller 30 with little, if any, delay.

The light sensor 10 may be any suitable light sensor. The light sensor 10 may sense one or more spectral channels. The light sensor 10 may, for example, be an avalanche photodiode, a solid-state photo-multiplier tube, a PN-junction photodiode, or a phototransistor.

In some, but not necessarily all examples, the light sensor 10 may be an ambient light sensor or an internal light sensor, or both. The purpose of an ambient light sensor is to detect ambient light incident on a display (not shown in FIG. 1). The purpose of an internal light sensor is to stabilise the light source's luminous flux and colour (e.g. white point).

The controller 30 is directly connected with the light source 20 of the display. The controller 30 provides a control signal 22 to the light source 20 that controls the light emitted at the display originating from the light source 20. The direct connection of the controller 30 and the light source 20 results in there being little, if any, delay in the light source 20 responding to the controller 30 control signal 22.

The light source 20 provides light that is output from the display. The controller 30 may control the light generated or, by means of amplitude, phase, or scattering modulation, the light path from generation to display. The light source 20 may take different forms depending on the configuration of the display for which the light source 20 provides illumination. For example, the light source 20 may, in some examples, comprise a backlight. For example, it may comprise a backlight for a transmissive or transflective liquid crystal display, either based on colour filters or field-sequential colour. In other examples, the light source 20 may comprise one or more light-emitting pixels such as in an organic light-emitting diode (OLED) display. In that case, the OLED luminance is controlled by sending global dimming commands to the OLED module.

The controller 30 receives a synchronization signal 40 which is used to control the timing of output from the display.

In this example, but not necessarily all examples, the controller 30, the light sensor 10 and the light source 20 are integrated within a module 4. The module 4 may, for example, be a lighting module for a display or, it may be a display module for a device. In the latter case, the module 4 will in addition comprise a display.

The module 4 may be integrated into a hand-portable electronic device.

The display (not illustrated in FIG. 1) may be any display, the output of which can be controlled to occur at one time and not occur at another time. In some, but not necessarily all examples, the display may be a liquid crystal display (LCD), a duty-driven organic light-emitting diode (OLED) display or any suitable duty-driven display such that there is a dark period in each display period.

Figure 2:
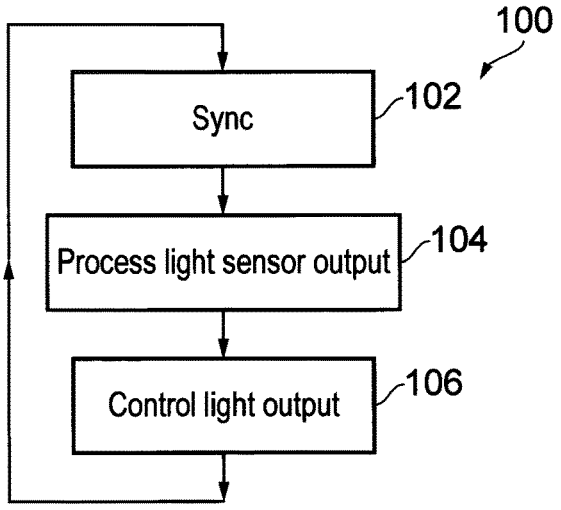
FIG. 2 illustrates an example of a method which may, for example, be performed by the apparatus.

FIG. 2 illustrates an example of a method 100 which may, for example, be performed by the apparatus 2.

At block 102, synchronization of a local time frame and refresh of a display is achieved.

At block 104, the method continues with processing an output 12 from a light sensor 10 from a first time ($t_1$) in the local time frame, for a first duration ($d_1$) to control light output of the display at a second time ($t_2$) in the local time frame for a second duration ($d_2$).

Figure 3:
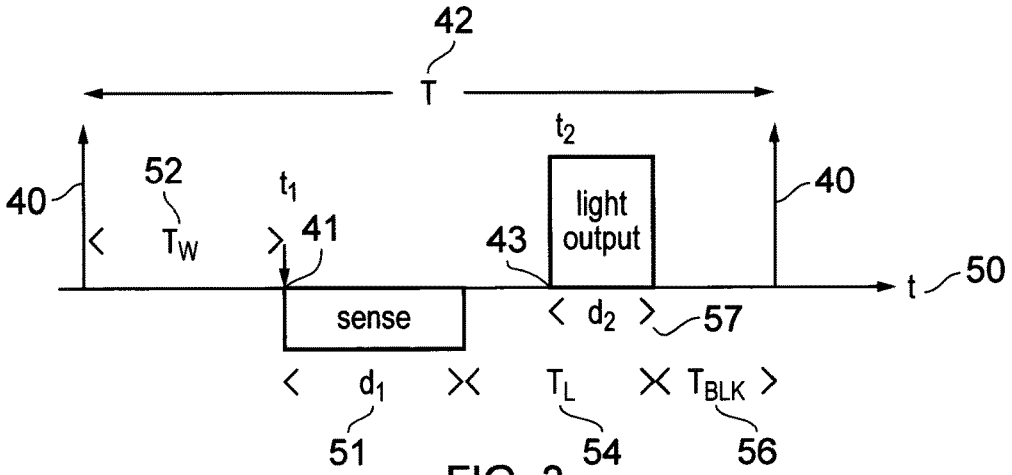
FIG. 3 illustrates an example of timing of a sensing event and a light output event in relation to a common local time frame.

The relationship of the first time $t_1$, the first duration $d_1$, the second time $t_2$ and the second duration $d_2$ may be better understood from FIG. 3, which illustrates one example of a relationship between the first and second times and the first and second durations.

Next, at block 106, the light output of the display at the second time $t_2$ is controlled for a second duration $d_2$ and depends upon output 12 from the light sensor 10 from the first time $t_1$ for the controlled first duration $d_1$. The light output may be controlled by modulating the light source directly by a voltage or current, the duration of the light output, or a combination thereof. If temporally modulated, the pulse may be aligned to the end point of duration d2

For example, the light source 20 of the display may be controlled to produce a light output that is in proportion to the output from the light sensor 12 over the first duration $d_1$.

FIG. 3 illustrates the timing of a sensing event and a light output event in relation to a common local time frame 50.

The synchronization of the light output event and the sensing event is achieved via the synchronization signals 40 which occur periodically every display period T 42.

The sensing event occurs at a first time $t_1$ after the synchronization signal 40 has been received and it lasts for a first duration $d_1$ 51.

The light output event occurs at a second time $t_2$ 43 for a second duration $d_2$ 57.

In this example, the first time 41 and the second time 43 occupy the same display period 42. However, in other examples, the first time 41 may occupy a display period 42 that precedes the display period 42 occupied by the second time 43. In other examples, the first time 41 may occupy a display period 42 that immediately precedes the display period 42 occupied by the second time 43.

The display period 42 is less than a maximum time determined by an inverse of a flicker fusion frequency. The flicker fusion frequency is typically greater than 60 Hz and depends on field of view, retinal luminance measured in Trolands (Tr), and frequency of the $1^{st}$ fundamental Fourier frequency of the light output. If the display has a variable refresh rate, it may be adjusted based on the input of the ambient light sensor in order to prevent flicker. For example, in the dark, the retinal luminance is higher because the pupil is larger due to adaptation to the dark surroundings. The minimum refresh rate may also be determined by the size of the display and the viewing distance.

In this particular example, in each display period 42, there is a duration $T_w$ 52 immediately following the synchronization signal 40 for writing an image to a liquid crystal display. This image data writing and LCD response duration 52 is immediately followed by the first duration 51. After the first duration 51 there is a lighting duration 54 which represents the maximum time available for the light source 20 to be switched on. In this example, the second duration 57 occupies a latter portion of the lighting duration 54. Following the second duration 57, there immediately follows a blanking time 56 for separating the current display period 42 from the following display period 42. The blanking time 56 may be a display blanking time period for blanking the display or a period for resetting counters, for example. The blanking time 56 may be zero and lighting time 57 may extend into the subsequent display period in some implementations. The display period 42 can consist of one or more frames, fields, or subfields. Fields and/or subfields may be divided by colour, interlacing, or grey shade modulation.

It will be noticed that in this example, the first duration 51 and the second duration 57 are non-overlapping. The light source 20 is switched off at least during the first duration 51. Furthermore the output 12 from the light sensor 10 is processed only while the light source 20 is switched off.

It is possible, however, in other implementations for the first duration 51 and the second duration 57 to overlap. In this overlapping example, the light source 20 is not switched off during the first duration 51 and an output 12 from the light sensor 10 during the first duration 51 is processed to compensate for sensing the light output from the light source 20 at the light sensor 10.

The sensing duration d1 may also be moved to overlap with light output duration d2. The overlapping mode may be triggered by a counter and/or a maximum threshold level of the ambient light level. Sensing is used to measure any output or spectral shift of the LEDs and compensate for that. This has to be done in the dark in order to measure only the light from the LEDs (or OLEDs). It is not necessary to do this very often so it may be controlled by a counter In both cases, the output 12 may be used to control the luminous flux and chromaticity in the subsequent frame, thereby calibrating the LED output.

In some, but not necessarily all, examples, it is additionally possible to measure an output 12 from the light sensor 10 during the second duration 57 and process it to assess performance of the light source 20. This processing may occur immediately, in real-time during the display period 42.

In some, but not necessarily all embodiments, the display period may be a field or subfield with a frequency significantly higher than the flicker fusion frequency.

The display period may be an illumination period for field-sequential colour displays and/or sub-field modulated displays Referring to FIGS. 2 and 3, it should be appreciated that the method 100 of FIG. 2 is repeated in each display period 42 and that the display period 42 in FIG. 3 is repeated as a concatenated sequence. Therefore, in each display period 42, there is synchronization 102 of a local time frame 50 and refresh of a display controlled by the synchronization signal 40. In addition, in each display period 42, there is processing of an output 12 from the light sensor 10. The processed output 12 is from a first time, in the local time frame 50, and lasts for a controlled first duration 51. It is used to control light output of the display at a second time in the local timeframe 50. The second time 43 is after the first time 41 and the light output lasts for a second duration 57.

Figure 4:
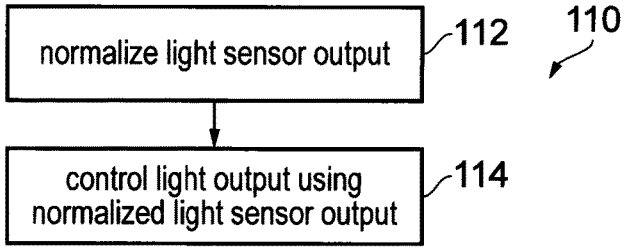
FIG. 4 illustrates an example of a method for controlling light output of the display.

FIG. 4 illustrates an example of a method 110 for controlling light output of the display at the second time 43 for the second duration 57. In this example, the light output is controlled in proportion to the output 12 of the light sensor 10 from the first time 41 for the sensing duration 51. That is, the light output at the display is controlled in proportion to the light sensed during the sensing event illustrated in FIG. 3.

The block 112, normalises the output from the light sensor 10. The block 114 controls the light output at the display in proportion to the normalised output from the light sensor 20

In one example, the normalisation uses a value that represents the filtering of light in the path from the light source 20 to human sensing. Alternatively, or additionally, the normalisation may use a user-controlled value.

In this example, at block 112, the output 12 from the light sensor 10 is normalised using a value that represents the spectral filtering of light in the path from the light source 20 to human sensing, multiplied by the International Commission on Illumination (CIE) $V_\lambda$ spectral sensitivity curve.

The value may, for example, take into account a value that represents spectral irradiance received from the light source 20 at the top of an optical stack comprising the display, a spectral flux transmittance of the optical stack comprising the display panel, a weighting for spectral filters (if present) and a spectral response of the human eye and the sensor, thereby giving a sensor output that equals the luminance in the plane of the display stack.

The spectral irradiance from ambient light sources received at the display panel may be estimated from a normalised post-gamma average pixel level (e.g., LCD panel transmittance for the particular frame), and the flux transmittance of a light guide plate, for example. In the case of a semi-transparent OLED, the transmittance does not depend on the average pixel level, and the spectral transmittance can simply be measured and stored in a memory.

The normalisation of the output from the light sensor 20 may be achieved using stored calibration data. In particular, the value that represents the filtering of light in the path from the light source to human sensing may be an experimentally determined value that is stored in a memory as calibration data.

Figure 5:
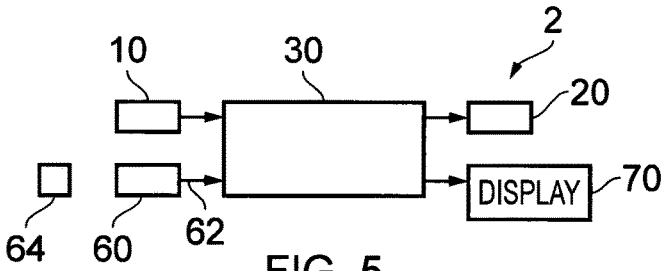
FIG. 5 illustrates an example of an apparatus similar to the apparatus illustrated in FIG. 1 and additionally comprising a display.

FIG. 5 illustrates an example of an apparatus 2 similar to the apparatus 2 illustrated in FIG. 1. However, in this example, the apparatus 2 comprises a display 70. The controller 30 is configured to control operation of the display 70.

Also, in this figure, there is a further light sensor 60 which may have an associated diffuser 64.

The apparatus 2 is configured to control output from the light source 20 to maintain a reproducible luminance and white point at the display 70. This may be achieved by adjusting a white point for the display 70.

In one example, the display 70 is a transflective display that has a first white point for the display 70 when it is operating in an emissive mode. The controller 30, during a transflective mode, adjusts the first white point for the display 70 to take account of a contribution to the total display output from the both emissive and reflective display output, thereby keeping the resulting contrast and white point constant regardless of illumination.

The controller 30 is configured to process an output 62 from the further light sensor 60 to estimate the contribution from the reflective display output. The further light sensor 60 has an associated diffuser 64 for converting specular light to a diffuse light before sensing, where the diffused light corresponds to the diffuse reflection of the reflective mode of the transflective display. In this way, an estimate of the effect of the specular light on the total light output may be estimated.

In some, but not necessarily all, examples of the apparatus 2 (of FIG. 1 or 5), the apparatus is configured such that there are equivalent light paths 71, in opposite directions for sensed ambient light 72 and for emitted light 73.

In this way, the field of view (FoV) of the light sensor 10 and of the light source 20 are the same. For example, as schematically illustrated in FIG. 6, the apparatus 2 is configured such that an angular/spatial distribution of sensed ambient light 72 is the same as an angular distribution of the emitted light 73. There is symmetry, the rays of the emitted ray 73 as seen by an observer are the same as the incident rays 71, that is they have the same angular distribution with respect to a normal vector.

Also in this example, the apparatus is configured such that a spectral modulation of sensed ambient light 72 by the optics 70 of the apparatus 2 is the same as a spectral modulation of the emitted light 73 by the optics 70 of the apparatus 2. In this way, if the output of the light source 20 is matched to the sensed light, then the output of the display is accurately matched to the ambient lighting conditions both with respect to luminance and colour temperature. Where the display is an LCD, a light source 20 with adjustable chromaticity is used, for example, individually controlled red, green, blue (RGB) light emitting diodes (LEDs). Where the display is an OLED or other emissive display, on-the-fly RGB gamma correction within one frame may be used. Where the display is a display with some transmittance, the light sensor 10 may be located below the display, provided that it has a field-of-view similar to the far field emission pattern of the display. In order to achieve equivalent light paths, it is convenient for the light sensor 10 and the light source 20 to be located adjacent one another. It is also convenient for the light sensor 10 and the light source 20 to share the same optics 70. In some, but not necessarily all, examples, the light sensor 10 and the adjacent light source 20 may have the same die size.

The position of the light sensor 10 and the light source 20 is only illustrative and the light sensor 10 and light source 20 may be placed, together, at different locations. They may, for example, be co-located at the edge of the display, for example, as illustrated in FIGS. 7A and 7B.

FIGS. 7A and 7B illustrate an example of an apparatus 2 similar to FIG. 6. In this example, the optics 70 shared by the light sensor 10 and the light source 20 comprise a light guide 76. FIG. 7A illustrates a light path for sensed ambient light 72. FIG. 7B illustrates a light path for emitted light 73 that is the specular equivalent of the incident ambient light 72, assuming that the display has an angularly symmetric response. The processing of the output 12 from the light sensor 10, for the first duration 51 to control the light output 73 of the display during the second duration, results in the light output 73 being equivalent to the incident ambient light 72. It should be noted that ray 72 and ray 73 are just indicative of example rays of a distribution that is identical in the two half planes defined by the normal and rays 72 and 73, respectively.

Therefore by having equivalent light paths 71, in opposite directions for the sensed ambient light 72 and the emitted light 73, it is possible to obtain an accurate control of the light output from the display 70 such that it matches the ambient lighting conditions.

Implementation of the controller 30 may be as controller circuitry. The controller 30 may be implemented in hardware alone, have certain aspects in software including firmware alone or can be a combination of hardware and software (including firmware).

As illustrated in FIG. 8A the controller 30 may be implemented using instructions that enable hardware functionality, for example, by using executable computer program instructions 84 in a general-purpose or special-purpose processor 82 that may be stored on a computer readable storage medium (disk, memory etc) to be executed by such a processor 82.

The processor 82 is configured to read from and write to the memory 80. The processor 82 may also comprise an output interface via which data and/or commands are output by the processor 82 and an input interface via which data and/or commands are input to the processor 82.

The memory 80 stores a computer program 84 comprising computer program instructions (computer program code) that controls the operation of the apparatus 2 when loaded into the processor 82. The computer program instructions, of the computer program 84, provide the logic and routines that enables the apparatus to perform the methods illustrated in FIGS. 2 & 4. The processor 82 by reading the memory 80 is able to load and execute the computer program 84.

The apparatus 2 therefore comprises:

at least one processor 82; and at least one memory 84 including computer program code 84 the at least one memory 80 and the computer program code 84 configured to, with the at least one processor 82, cause the apparatus 2 at least to perform:

causing synchronisation of a local time frame and refresh of a display;

processing an output from a light sensor from a first time, in the local time frame, for a controlled first duration to control light output of the display at a second time, in the local time frame and after the first time, for a second duration.

As illustrated in FIG. 8B, the computer program 84 may arrive at the apparatus 2 via any suitable delivery mechanism 88. The delivery mechanism 88 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 84. The delivery mechanism 88 may be a signal configured to reliably transfer the computer program 84. The apparatus 2 may propagate or transmit the computer program 84 as a computer data signal.

Although the memory 80 is illustrated as a single component/circuitry it may be implemented as one or more separate components/circuitry some or all of which may be integrated/removable and/or may provide permanent/semi-permanent/dynamic/cached storage.

Although the processor 82 is illustrated as a single component/circuitry it may be implemented as one or more separate components/circuitry some or all of which may be integrated/removable. The processor 82 may be a single core or multi-core processor.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The blocks illustrated in the FIGS. 2 & 4 may represent steps in a method and/or sections of code in the computer program 84. The illustration of a particular order to the blocks does not necessarily imply that there is a required or preferred order for the blocks and the order and arrangement of the block may be varied. Furthermore, it may be possible for some blocks to be omitted.

Where a structural feature has been described, it may be replaced by means for performing one or more of the functions of the structural feature whether that function or those functions are explicitly or implicitly described.

The light sensor 10 performs the function of sensing light and may be replaced by any suitable light sensing means. It may be a light detector.

The light source 20 performs the function of providing light used by a display and may be replaced by any suitable lighting means.

The controller 30 performs the function of processing the output of the light sensor 10 and causing an effect on the light output at the display, for example, causing an effect on the light output at the display originating from the light source 20 and may be replaced by any suitable control or processing means. The controller 30 may be, for example, a processor (including dual-core and multiple-core processors), digital signal processor, controller, encoder, decoder. It some but not necessarily all examples it may comprise memory such as, for example, random access memory (RAM) or read only memory (ROM). It some but not necessarily all examples it may use, for example, software or firmware.

The display 70 performs the function of providing content to a user visually and may be replaced by any suitable display means. The display 70 comprises display circuitry.

As used here 'module' refers to a unit or apparatus that excludes certain parts/components that would be added by an end manufacturer or a user.

The controller 30 may be a module. The controller 30 in combination with the light sensor 10 and light source 20 may be a module. The controller 30 in combination with the light sensor 10, light source 20 and lightguide 76 may be a module.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one." or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class.

Although embodiments of the present invention have been described in the preceding paragraphs with reference to various examples, it should be appreciated that modifications to the examples given can be made without departing from the scope of the invention as claimed.

For example, in some examples an image may be colour separated into primary colour planes. In displays where grey shade is created by subfield duration, each subfield is called a bit plane, representing the bit values of the grey shade. All these colour planes or grey shade planes are summed up to an image. The above described examples can be applied to displays that form the image either directly or via image planes e.g. colour planes or bit planes. Therefore, the timings, for example as illustrated in FIG. 3, can be applied to either frame, field, or subfield, the two latter of which correspond to different planes of image data. The terms 'display period' and 'image', for example, should be interpretted to cover these examples.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A method comprising:

synchronizing a local time frame and a refresh of a display with a synchronization signal, said synchronization signal starting a display period;

writing an image to the display during a write duration of the display period, said write duration following said synchronization signal;

processing an output from a light sensor from a first time, in the local time frame, for a first duration following said write duration to control light output of the display, said light sensor not being processed during said write duration, said light output starting at a second time, in the local time frame and after the first time, for a second duration, said light output from the display being based upon the output from the light sensor; and outputting light from the display only during the second duration, said second duration not overlapping with the write duration.

2. The method as claimed in claim 1, wherein, for an additional display period, the local time frame and the refresh of the display are synchronized.

3. The method as claimed in claim 1, wherein, for an additional display period, the output from the light sensor is processed from the first time, in the local time frame, for the first duration after said write duration to control light output of the display starting at a second time, in the local time frame and after the first time, for the second duration.

4. The method as claimed in claim 1, wherein the first time and the second time are in the same display period.

5. The method as claimed in claim 1, wherein the first time is in a display period preceding the display period of the second time.

6. The method as claimed in claim 1, wherein the display period is less than a maximum time determined by an inverse of the flicker fusion frequency.

7. The method as claimed in claim 1 wherein, in an additional display period, the first time is preceded by writing an image to the display.

8. The method as claimed in claim 1, wherein, in the display period, an end of the second duration is followed by a blanking time.

9. The method as claimed in claim 1, wherein, in an additional display period, there is the write duration for writing an image, the first duration for sensing, the second duration for illuminating, and a further duration for blanking.

10. A computer program product comprising a non-transitory computer readable storage medium bearing computer program code embodied therein for use with a computer, the computer program code comprising code for performing the method of claim 1.

11. The method as claimed in claim 1, wherein ambient light sensed during a sensing event in one display period is used to adjust the light output of the display during a light output event of the same display period, wherein each display period comprises a single write duration, a first duration for the sensing event, a second duration for the light output event for displaying an image written during the write duration of the same display period.

12. An apparatus comprising:

at least one processor; and at least one memory including computer program code, the at least one memory and the computer program code being configured, with the at least one processor, to cause the apparatus at least to perform:

synchronizing a local time frame and a refresh of a display with a synchronization signal, said synchronization signal starting a display period;

writing an image to the display during a write duration of the display period, said write duration following said synchronization signal;

processing an output from a light sensor from a first time, in the local time frame, for a first duration following said write duration to control light output of the display, said light sensor not being processed during said write duration, said light output starting at a second time, in the local time frame and after the first time, for a second duration, said light output from the display being based upon the output from the light sensor; and outputting light from the display only during the second duration, said second duration not overlapping with the write duration.

13. The apparatus as claimed in claim 12, further comprising the light sensor.

14. The apparatus as claimed in claim 13, wherein the light sensor has multiple different spectral channels.

15. The apparatus as claimed in claim 13, wherein the light sensor is selected from the group consisting of an avalanche photodiode, a solid-state photo-multiplier tube, a PN-junction photodiode, and a phototransistor.

16. The apparatus as claimed in claim 12, wherein the apparatus has equivalent light paths, in opposite directions, for sensed ambient light and for emitted light.

17. The apparatus as claimed in claim 12, wherein an angular distribution of sensed ambient light is the same as an angular distribution of emitted light.

18. The apparatus as claimed in claim 12, wherein a spectral modulation of ambient light sensed by the apparatus is the same as a spectral modulation of light emitted by the apparatus.

19. The apparatus as claimed in claim 12, further comprising:

an ambient light sensor for sensing ambient light;

a light source for emitting light; and optics shared by the light sensor and the light source, wherein the optics provide equivalent light paths, in opposite directions, for ambient light sensed at the light sensor and for emitted light emitted from the light source.

20. An apparatus comprising:

at least one processor; and at least one memory including computer program code, the at least one memory and the computer program code being configured, with the at least one processor, to cause the apparatus at least to perform:

switching a light source for a display off during a write duration and during a first duration of a display period, said first duration following said write duration;

measuring ambient light during the first duration of the display period, said ambient light not being processed during said write duration; and switching the light source for the display on during a second duration of the display period with an adjusted light output, said adjusted light output being dependent on the measurement of ambient light made during the first duration of the display period, said second duration being after said first duration, said second duration not overlapping with the write duration and not overlapping with the first duration.

* * * * *